US009868000B2

(12) United States Patent
Huang et al.

(10) Patent No.: US 9,868,000 B2
(45) Date of Patent: Jan. 16, 2018

(54) DESCENT RESCUE DEVICE WITH DOUBLE BRAKE AND BACK AND FORTH CONTROLLED

(71) Applicant: GUANGZHOU ZHUANZHE ELECTRONIC TECHNOLOGY CO., LTD., Guangzhou, Guangdong (CN)

(72) Inventors: Boyuan Huang, Guangdong (CN); Qianjing Huang, Guangdong (CN)

(73) Assignee: Guangzhou Zhuanzhe Electronic Technology Co., Ltd, Guangzhou (CN)

( * ) Notice: Subject to any disclaimer, the term of this patent is extended or adjusted under 35 U.S.C. 154(b) by 62 days.

(21) Appl. No.: 14/760,485

(22) PCT Filed: Jun. 5, 2013

(86) PCT No.: PCT/CN2013/076747
§ 371 (c)(1),
(2) Date: Jul. 13, 2015

(87) PCT Pub. No.: WO2014/117460
PCT Pub. Date: Aug. 7, 2014

(65) Prior Publication Data

US 2015/0352380 A1 Dec. 10, 2015

(30) Foreign Application Priority Data

Jan. 30, 2013 (CN) ..... 2013 1 0035997

(51) Int. Cl.
*B65H 59/16* (2006.01)
*A62B 1/10* (2006.01)

(52) U.S. Cl.
CPC ..... *A62B 1/10* (2013.01)

(58) Field of Classification Search
CPC ..... A62B 1/10; A62B 35/0093; B66B 5/04; B66B 11/043; B66B 1/20; F16D 59/00
(Continued)

(56) References Cited

U.S. PATENT DOCUMENTS 3,946,989 A * 3/1976 Tsuda ..... A62B 1/10 182/241
5,090,666 A * 2/1992 May ..... B66D 1/7415 254/329

(Continued)

FOREIGN PATENT DOCUMENTS

CN 2252012 Y * 4/1997
CN 2319080 Y * 5/1999

(Continued)

OTHER PUBLICATIONS

English translation of CN 2252012Y document obtained via https://worldwide.espacenet.com/ on Dec. 12, 2016.*

(Continued)

*Primary Examiner* — Pamela Rodriguez

(57) ABSTRACT

A descent rescue device with a double brake with back and forth control comprising an outer shell, a tyra mechanism, a wedge wheel and a double braking mechanism, wherein the double braking mechanism comprises an outer braking component, an inner braking component and a locking mechanism, the inner braking component is operatively associated with the energy conversion adjusting screw of the tyra mechanism, the wedge wheel is disposed between the inner braking component and the outer braking component, a bundle of steel wire rope is wrapped around the wedge wheel, and when no force or a force beyond a maximum threshold acts on the outer braking component, the steel wire rope wrapped on the wedge wheel is locked; when a force lower than the maximum threshold acts on the outer braking component, the steel wire rope is unlocked.

8 Claims, 4 Drawing Sheets

(58) Field of Classification Search
USPC ..... 188/65.3, 180, 188; 182/3, 73, 74, 75, 182/241; 254/267, 375, 378; 242/381, 242/381.5
See application file for complete search history.

(56) References Cited

U.S. PATENT DOCUMENTS

| | | | | |
|---|---|---|---|---|
| 8,800,715 | B2 * | 8/2014 | Olson | A62B 1/10 182/231 |
| 9,121,462 | B2 * | 9/2015 | Casebolt | A62B 1/10 |
| 9,415,973 | B2 * | 8/2016 | Rottlaender | B66D 1/20 |

FOREIGN PATENT DOCUMENTS

| | | | | |
|---|---|---|---|---|
| CN | 201123960 | Y | * | 10/2008 |
| CN | 201519389 | U | * | 7/2010 |
| CN | 202070033 | U | * | 12/2011 |
| CN | 203060615 | U | * | 7/2013 |
| GB | 999553 | A | * | 7/1965 |

OTHER PUBLICATIONS

English translation of CN 2319080Y document obtained via https://worldwide.espacenet.com/ on Dec. 12, 2016.*

* cited by examiner

A----A

DESCENT RESCUE DEVICE WITH DOUBLE BRAKE AND BACK AND FORTH CONTROLLED

BACKGROUND OF THE INVENTION

Field of the Invention

The present invention relates to a descent rescue device, more especially related to a descent rescue device with a double brake with back and forth control to enable people to rescue themselves or others high above the ground.

Description of the Prior Art

Nowadays, there are more and more high buildings in the city. If a fire, earthquake or accident of a sightseeing cable car occurred, how can people escape safely from the high buildings? Because the height of a fire ladder is limited and an elevator is not allowed to be used, it is hard to rescue people in the high buildings and put out the fire. At present, there are a variety of descent rescue devices developed for escaping from high buildings, however, these descent rescue devices have the following defects: (1) firstly, the present descent rescue devices are too heavy or too big to carry; (2) secondly, the present descent rescue devices could not be slowed down or stopped in the air; (3) thirdly, it is difficult to control the state and descent speed; (4) fourthly, the high-speed friction causes wear and tear of internal components, which even causes a lot of potential dangers.

Because of the above mentioned defects and safety issues, the descent rescue devices are almost not applicable in reality. Therefore, it is necessary to provide a descent rescue device with a high safety coefficient and good controllability.

SUMMARY OF THE INVENTION

In order to overcome the above mentioned defects, the main purpose of the present invention is to provide a descent rescue device which is operable to halt or to be slowed down and could be moved back and forth from a high building to the ground.

To achieve the purpose of the invention, the present invention provides a descent rescue device with a double brake with back and forth control comprising an outer shell and a tyra mechanism, a wedge wheel, a double braking mechanism and a line-guiding mechanism disposed inside the outer shell, wherein the tyra mechanism comprises an energy conversion adjusting screw having an elastic buffer disposed thereon, the double braking mechanism comprises an outer braking component, an inner braking component and a locking mechanism, wherein the inner braking component is operatively associated with the energy conversion adjusting screw of the tyra mechanism, the wedge wheel is disposed between the inner braking component and the outer braking component, a bundle of steel wire rope is wrapped around the wedge wheel, the locking mechanism abuts against the outer braking component and the outer shell; wherein during rescue operation, when no force or a force beyond a maximum threshold acts on the outer braking component, the wedge wheel is locked by the outer braking component and inner braking component; while a force lower than the maximum threshold acts on the outer braking component, the energy conversion adjusting screw of the tyra mechanism triggers the inner braking component to provide a certain damping force which is lower than the gravity of a target being rescued such that the steel wire rope exits the outer shell guided by the line-guiding mechanism.

The steel wire rope comprises a free end; when the tyra mechanism is fastened to a building, the free end of the steel wire rope is fastened to a target being rescued; when the free end of the steel wire rope is fastened to the building, the tyra mechanism is fastened to the target being rescued.

In the present invention, the inner braking component comprises a main axis, a first braking block, a braking hub, a second braking block, a block linkage arm and a block closing rotation roller, wherein the first braking block is disposed on the main axis, and operatively connected with the energy conversion adjusting screw of the tyra mechanism via the block linkage arm and the block closing rotation roller, the brake hub is disposed between the friction blocks and the second braking block and fixed with the wedge wheel, and during the rescue operation, when the tyra mechanism is pulled out of the outer shell by the gravity of the target being rescued, the energy conversion adjusting screw of the tyra mechanism then pulls the block linkage arm to rotate together with the block closing rotation roller, then the rotating block closing rotation roller pushes the first braking block against the brake hub and the second braking block to provide the damping force which is lower than the gravity of a target being rescued.

The first braking block comprises a first friction block and a second friction block; the main axis supported on a shaft plate comprises two opposite ends having two block gaps receiving the first and second friction blocks, the first friction block is connected to the energy conversion adjusting screw of the tyra mechanism via the block linkage arm and the block closing rotation roller; wherein during the rescue operation, the energy conversion adjusting screw pulls the block linkage arm to rotate together with the block closing rotation roller, then the rotating block closing rotation roller pushes the first friction block against the brake hub.

The outer braking component comprises a power handle and a helping handle, wherein the power handle is connected to the block linkage arm via a linkage arm, and the helping handle is fixed to the outer shell; when no force acts on the power handle and the helping handle, the locking mechanism is operationally associated with the outer brake component and abuts against the power handle and the helping handle to hold the position of the power handle, and presses the outer braking component against the brake hub to lock the brake hub and the wedge wheel; when the force beyond the maximum threshold acts on the power handle and the helping handle, the power handle then drives the linkage arm to push the block closing rotation roller to rotate, the rotating block closing rotation roller pushes a first friction block against the brake hub to lock the brake hub, when the force lower than the maximum threshold acts on the power handle, power handle moves towards the helping handle and pressed against the locking mechanism, the locking mechanism releases the outer braking component to unlock the brake hub.

The locking mechanism further comprise a brake-adjusting nut, a brake-tightening spring, a braking assembly base and a brake-pushing puller, wherein the braking assembly base is fixed to the outer shell and has a through hole; one end of the brake-pushing puller far from the power handle passes through the through hole; the brake-adjusting nut fixes the outer braking component to the brake-pushing puller, the brake-tightening spring abuts against the brake-adjusting nut and the braking assembly base.

The tyra mechanism further comprises a hanging ring, a spring traction tube and a buffer tube, the buffer comprises an energy conversion spring and a buffer spring, the energy conversion spring abuts against the energy conversion adjusting screw and the spring traction tube, and the buffer spring abuts against the spring traction tube and the buffer tube, the hanging ring is connected with the buffer tube.

The line-guiding mechanism comprises a pair of guide wheels, a sliding briquetting and a briquetting spring, wherein the guide wheels are disposed near a opening of the outer shell, the steel wire rope passes through the gap between the guide wheels, the sliding briquetting is disposed beside the guide wheels, the briquetting spring abuts against the sliding briquetting and the outer shell pressing the sliding briquetting against the guide wheels.

The guide angle of the wedge wheel is between 25° and 35°. And the optimum value for the guide angle is 30°. Appropriate guide angle could prevent the steel wire rope from sliding off the wedge wheel, so the target being rescued could get down safely.

The outer braking component and the line-guiding mechanism are disposed at different sides of the outer shell to avoid interference between the outer braking component and the steel wire rope.

Compared with the prior art, the descent rescue device with double brake and back and forth control in the present invention has advantages as follows:

During the rescue operation, the status and speed of the device could be controlled by the operation of the outer braking component. When no force or the force beyond the maximum threshold acts on the outer braking component, the double braking mechanism would lock the descent rescue device and hold the position of the target being rescued. When a force lower than the maximum threshold acts on the outer braking component, the descent rescue device would be unlocked.

The first braking block, in one aspect, provides damping force to control the descent speed of the target being rescued, and in another aspect locks the descent rescue device to hold the position of the target being rescued as long as a force beyond the maximum threshold acts on the power handle in case the target being rescued is in a panic.

Multiple configurations are deployed to slow down the descent. The springs in the buffer produce certain elastic restoring force for resisting the load gravity; the heavier the target, the larger the elastic restoring force. The elastic restoring force would be converted into damping force applied to the braking hub. Meanwhile multiple friction components apply damping force to the braking hub to control the descent speed.

The device could be used by multiple persons repeatedly during one rescue operation. When the tyra mechanism is fastened to a building, multiple targets could get down to the ground with the free end of the steel wire rope; when the free end of the steel wire rope is fastened to the building, one can rescue himself with the tyra mechanism fastened to himself.

Resetting the easily worn components and outer braking components can be done by spring. By setting springs in a particular position, we can achieve real-time correction and resetting of the easily worn components and outer braking component to avoid wear and tear or deviations or other potential danger so as to secure the operational states and high accuracy for long-term usage.

| | | | |
|---|---|---|---|
| descent rescue device with double brake and back and forth controlled | 100 | outer shell | 1 |
| tyra mechanism | 2 | adjusting screw | 20 |
| Buffer | 21 | energy conversion spring | 210 |
| buffer spring | 212 | hanging ring | 22 |
| spring traction tube | 23 | holder of traction tube | 230 |
| buffer tube | 24 | energy conversion puller | 25 |
| double braking mechanism | 3 | outer braking component | 30 |
| power handle | 301 | helping handle | 302 |
| linkage arm | 303 | adjusting bolt | 304 |
| inner braking component | 31 | main axis | 310 |
| block closing rotation roller | 310a | block linkage arm | 310b |
| handle linkage axis | 310c | the first friction block | 310d |
| The second friction block | 310e | block fixed pin | 310f |
| block gap | 311a | brake hub | 312 |
| the second braking block | 313 | braking rocker arm | 314 |
| braking arm hinge | 315 | locking mechanism | 32 |
| brake-pushing puller | 320 | brake-adjusting nut | 321 |
| brake-tightening spring | 322 | braking assembly base | 323 |
| line-guiding mechanism | 4 | guide wheel | 40 |
| sliding briquetting | 41 | briquetting spring | 42 |
| rope ring | 51 | rolled plate | 52 |
| wedge wheel | 6 | shaft plate | 7 |

DETAILED DESCRIPTION OF PREFERRED EMBODIMENTS

Detailed Description of the Invention

Figure 1:
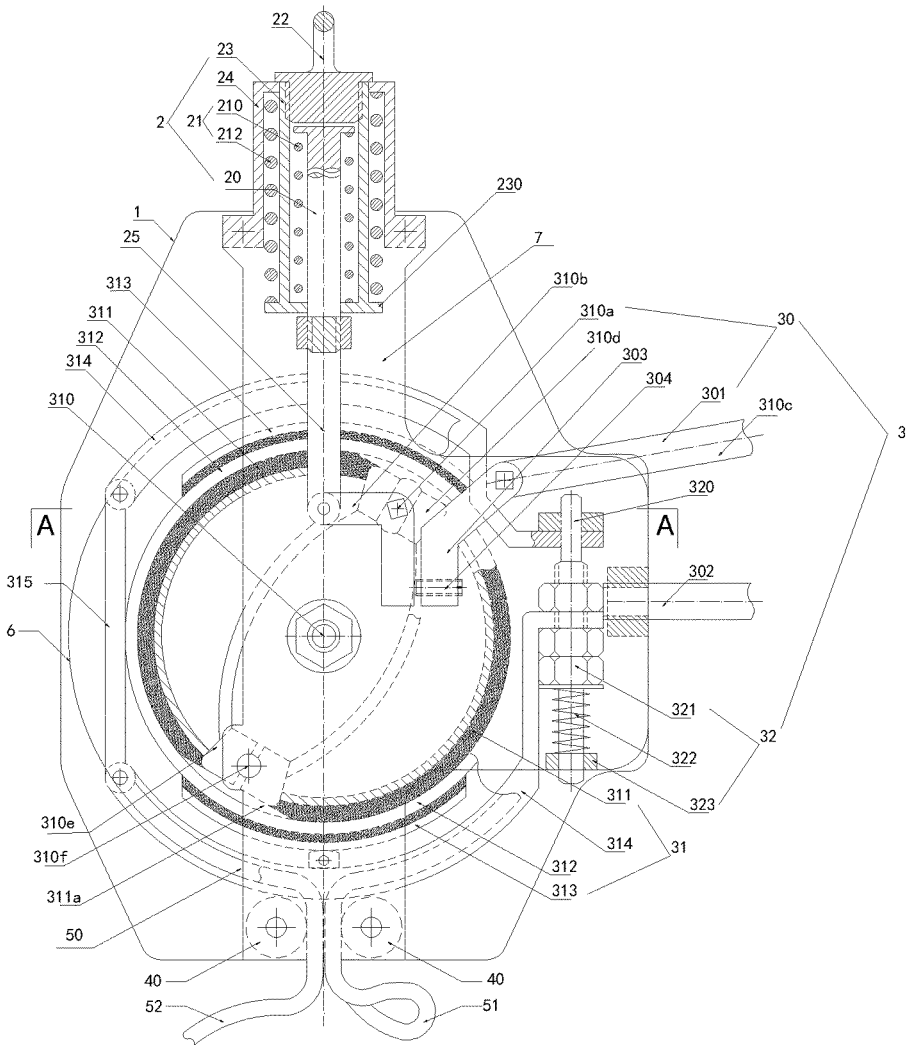
FIG. 1 is a front section view of a descent rescue device with a double brake with back and forth control in the present invention.
Figure 2:
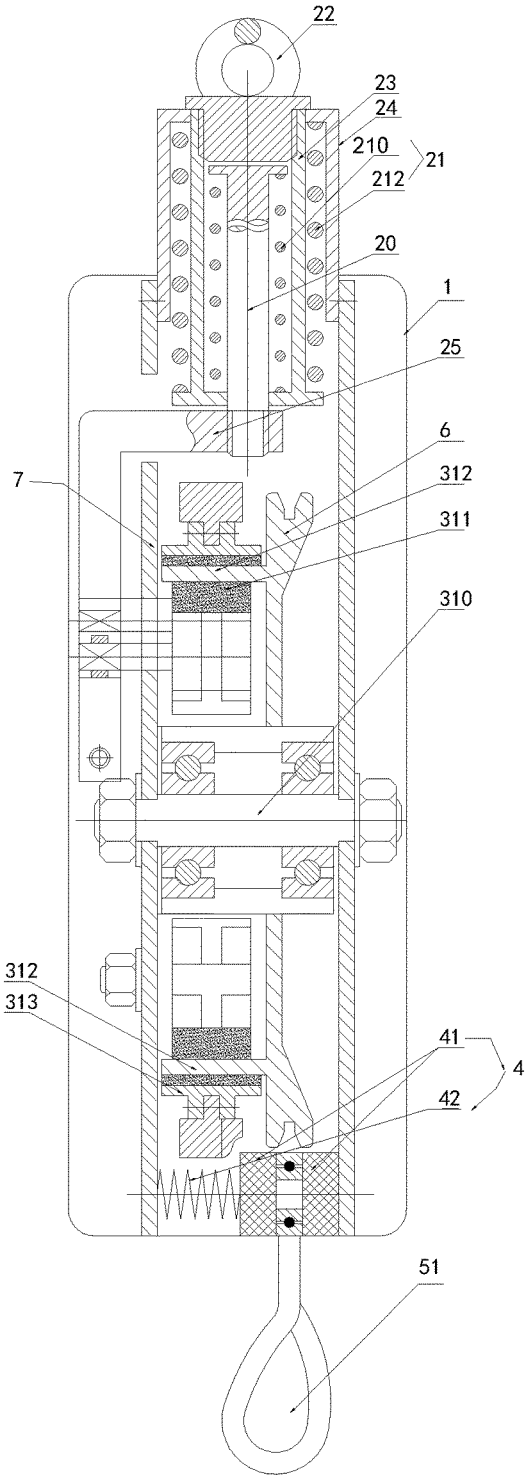
FIG. 2 is a side section view of a descent rescue device with a double brake with back and forth control in the present invention.
Figure 3:
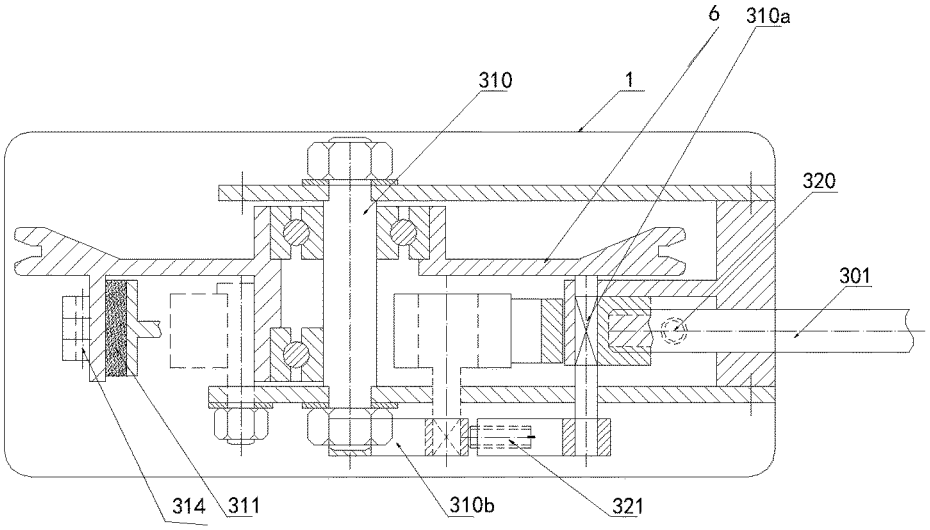
FIG. 3 is a vertical section view of a descent rescue device with a double brake with back and forth control in the present invention.

Refer to FIGS. 1-3, the present invention provides a descent rescue device with a double brake with back and forth control comprising an outer shell 1 and a tyra mechanism 2, a wedge wheel 6, a double braking mechanism 3 and a line-guiding mechanism 4 disposed inside the outer shell. The tyra mechanism 2 comprises an energy conversion adjusting screw 20 having an elastic buffer 21 disposed thereon, the double braking mechanism 3 comprises an outer braking component 30, an inner braking component 31 and a locking mechanism 32, wherein the inner braking component 31 is operatively associated with the energy conversion adjusting screw 20 of the tyra mechanism 2, the wedge wheel 6 is disposed between the inner braking component 31 and the outer braking component 30, a bundle of steel wire rope 50 is wrapped around the wedge wheel 6, the locking mechanism 32 abuts against the outer braking component 30 and the outer shell 1; wherein during a rescue operation, when no force or a force beyond a maximum threshold acts on the outer braking component 30, the wedge wheel 6 is locked by the outer braking component 30 and inner braking component 31; while a force lower than the maximum threshold acts on the outer braking component 30, the energy conversion adjusting screw 20 of the tyra mechanism 2 triggers the inner braking component 31 to provide certain damping force which is lower than the gravity of a target being rescued such that the steel wire rope 50 exits the outer shell 1 guided by the line-guiding mechanism 4.

The outer shell 1 is provided for housing all the components and mobility. The total weight of the descent rescue device 100 is about 3.4 Kg (not include the steel wire rope 50). The tyra mechanism 2 could extend from the top surface of the outer shell 1 and be hung on a high building. And then the outer braking component 30 could extend from the side surface of the outer shell 1, so that the descent rescue device 100 would be controlled in the state of lock or unlock by pulling the outer braking component 30. The tyra mechanism 2 comprises the energy conversion adjusting screw 20, the buffer 21, a hanging ring 22, a spring traction tube 23 and a buffer tube 24. The buffer 21 is disposed on the energy conversion adjusting screw 20. The spring traction tube 23 and the buffer tube 24 are wrapping each other and the buffer 21 is disposed in the spring traction tube 23 and the buffer tube 24. The hanging ring 22 and the energy conversion adjusting screw 20 are disposed separately with each other, and the hanging ring 22 extends from the upper end of the tyra mechanism 2. If a target is rescued by others, it is needed to fix the hanging ring 22 onto the building; in the case of self rescue, then it is needed to wrap the hanging ring 22 around oneself and fix the rope ring 51 onto the building.

The buffer 21 comprises an energy conversion spring 210 and a buffer spring 212. The energy conversion spring 210 abuts against the energy conversion adjusting screw 20 and the spring traction tube 23, and the buffer spring 212 abuts against the spring traction tube 23 and the buffer tube 24. In the present embodiment of the invention, for convenience of assembly, the spring traction tube 23 is nested in the buffer tube 24. The spring traction tube 23 is configured as an inner sleeve which has an inner wall longer than that of the buffer tube 24. A holder of traction tube 230 is provided at the bottom of the spring traction tube 23, which elongates both inside and outside the spring traction tube 23. The energy conversion spring 210 is disposed on the energy conversion adjusting screw 20, and one of free end of the energy conversion spring 210 abuts against the inner surface of the holder of traction tube 230 and presses against the holder of traction tube 230 in one extended direction of the energy conversion spring 210. The buffer tube 24 is configured as an outer sleeve. The buffer spring 212 is received in a circular cylinder cavity enclosed by the spring traction tube 23 and the buffer tube 24, and one free end of the buffer spring 212 presses against the holder of traction tube 230. In the present embodiment, the elasticity coefficient of the buffer spring 212 is larger than that of the energy conversion spring 210, that is to say, the absorbed energy by the buffer spring 212 is greater than that of the energy conversion spring 210. While under effect of equal force, the deformation coefficient of the buffer spring 212 is smaller than that of the energy conversion spring 210. The sum of the elastic restoring force generated by the buffer spring 212 and the energy conversion spring 210 equals to weight of the target being rescued. With buffer of the buffer spring 212 and the energy conversion spring 210, especially under the condition of overload, for example when the descent rescue device is carrying two people, the buffer spring 212 could absorb more energy in order to take a buffer action for the target being rescued during the descent. The main function of the energy conversion spring 210 is to convert the deformation energy into mechanical energy. The mechanical energy is transmitted from the energy conversion spring 210 and the energy conversion adjusting screw 20 and the energy conversion puller 25 to a block linkage arm 310*b*.

Figure 4:
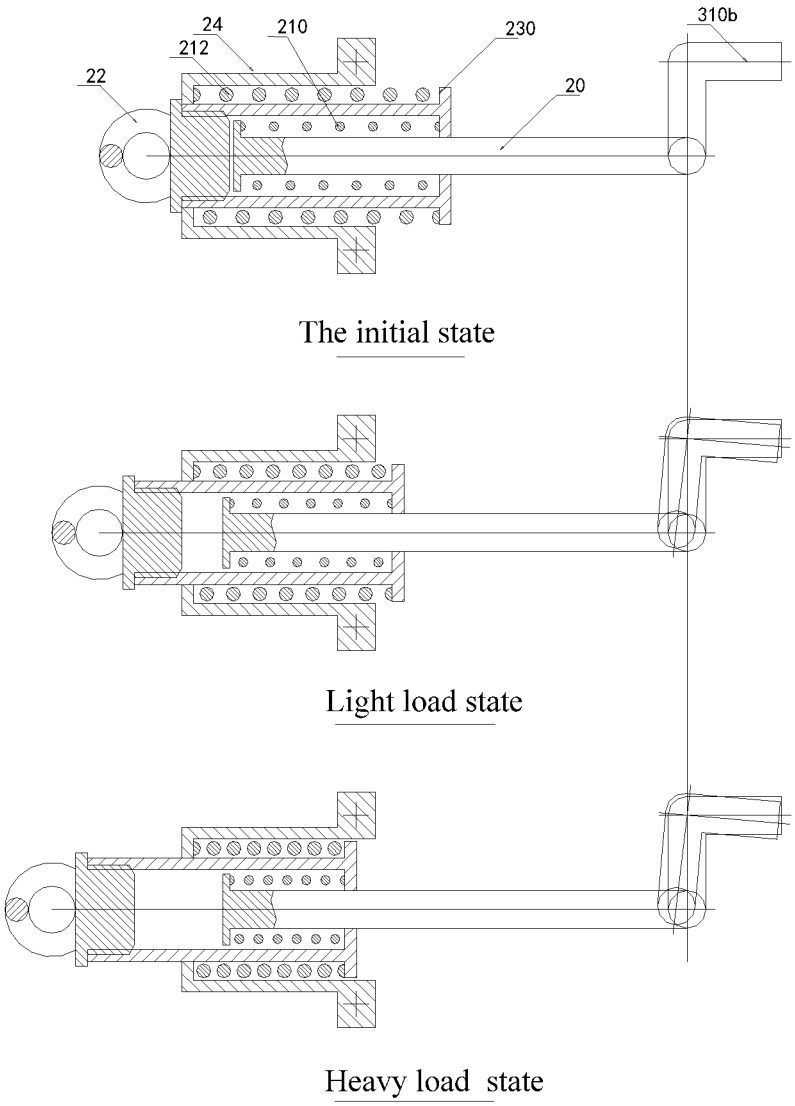
FIG. 4 is a view of a descent rescue device with a double brake with back and forth control in the present invention under load state.

Referring to FIG. 4, under the change of the load state of the descent rescue device, the compression of the energy conversion spring 210 and the buffer spring 212 of the tyra mechanism 2 would be changed correspondingly by the change of load weight. At the initial status with no load (target being rescued), the block linkage arm 310*b* is in a relaxed state, and the block linkage arm 310*b* would be rotated by the pulling of the energy conversion adjusting screw 20 and the energy conversion puller 25. And then, the energy conversion spring 210 would also be compressed by the pulling of a bulge on the top of the energy conversion adjusting screw 20 so as to balance the gravity of the load and produce buffering in the descent. If the weight of the load is light, the buffer spring 212 would be not deformed; if the load is larger, the energy conversion spring 210 would be deformed by the pulling of the energy conversion adjusting screw 20 continually. At this time, the buffer tube 24 would be pulled down by the whole descent rescue device which compresses the buffer spring 212. And then, the buffer spring 212 and the energy conversion spring 210 would also to be deformed by compression so that a great elastic restoring force could be produced for balancing the gravity of the load to make someone slow down at constant speed. During the descent, the energy conversion spring 210 and the buffer spring 212 are acting as a buffer component. For best results, the descent speed is controlled within 0.16-3 m/s.

In order to avoid accidents, a series of security and restrictive constraints should be set to the descent rescue device. The descent rescue device is configured to be operated by an adult only, not by children. In one embodiment of the present invention, the lowest load capacity could be limited to 29 Kg. Therefore the adult whose weight is over 29 Kg could use the descent rescue device by himself. The child whose weight is less than 29 Kg could use the descent rescue device accompanied by an adult. If the load is less than 29 Kg, then the descent rescue device would keep in the initial braking state and the steel wire rope would be locked. When the tyra mechanism 2 is fastened to the building and the free end of the steel wire rope is tied at the body of the target being rescued, the target being rescued can descend with the steel wire rope. When the free end of the steel wire rope is fastened to the building and the tyra mechanism 2 is fastened to the body of the target being rescued, the target being rescued can also descend to any place in air with the descent rescue device. It is easy to understand that load capacity of the descent rescue device is adjusted by energy conversion with the energy conversion adjusting screw.

The inner braking component 31 comprises a main axis 310, the first braking block 311, a braking hub 312, a second braking block 313, the block linkage arm 310*b* and a block closing rotation roller 310*a*. The braking hub 312 is disposed between the first braking block 311 and the second braking block 313. The cross section of the main axis 310 is an oval. The axis center of main axis 30 is supported by the shaft plate 7 with screw. The upper part of the main axis 310 is connected to the energy conversion puller 25. The axletrees on the ends of the main axis 310 are provided for supporting the wedge wheel 6 and brake hub 312. The energy conversion puller 25 is connected with the energy conversion adjusting screw 20 of the tyra mechanism 2. The main axis 310 would be rotated and shifted by the pulling of the energy conversion adjusting screw 20. A first friction block 310*d* and a second friction block 310*e* are disposed at the two ends of the main axis 310 symmetrically and fixed onto the shaft plate 7 respectively. The first friction block 310*d* is connected to the block linkage arm 310*b* by the block closing rotation roller 310*a*, and the block linkage arm 310*b* is connected to the energy conversion adjusting screw 20 of the tyra mechanism 2. The block linkage arm 310*b* may be L-shaped. One end of the block linkage arm 310*b* is connected to the energy conversion puller 25 and the center of the block linkage arm 310*b* is fixed on the first friction block 310*d*. Two block gaps 311*a* are respectively disposed on the two ends of the main axis 310. The diameter of the block gaps 311*a* is adapted to that of the first friction block 310*d* and the second friction block 310*e*. The second friction block 310*e* is disposed in one of the block gaps 311*a* and fixed on the shaft plate 7 by block fixed pin 310*f*, and then the second friction block 310*e* could not be rotated with the main axis 310 to ensure the first friction block 310*d* to press against the first braking block 311 during the descent. The block linkage arm 310*b* is configured as a cam. When the load capacity reaches a certain weight, during the descent of the descent rescue device, the block linkage arm 310*b* is rotated and pushes the first friction block 310*d* to rotate in the block gap 311*a* by the pulling of the energy conversion puller 25, so as to push the first friction block against the brake hub 312 and the second braking block 313 and to generate damping force between the first friction block 310*d* and the brake hub 312.

The brake hub 312 may be disposed between the friction blocks and the second braking block 313. The second braking block 313, the brake hub 312 and the first braking block 311 are configured as two groups of brake mechanisms one nesting within another, which could lock or unlock the descent rescue device during the descent of the descent rescue device 100. During descent of the descent rescue device 100, the tyra mechanism 2 is pulled out from the outer shell 1 and the main axis 310 could be rotated by the pulling of the tyra mechanism 2, and the main axis 310 is pressed against the two sides of the first friction block 310*d*, and then the first friction block 310*d* is pressed against the brake hub 312 and the second braking block 313 with an outward force. The damping force between the first braking block 311, the brake hub 312 and the second braking block 313 is equal to the weight of the target being rescued. The damping force between the first braking block 311 and the brake hub 312 and the second braking block 313 might be configured to be proportional to the weight of people. That is to say, if the target is heavier, the damping force is greater. In the present invention, the rotation angle range of the first friction block 310*d* might be configured in the range of 2-3 degrees. So that the damping force is proportional to the weight of the target. The increase of the weight of the target could be converted into a larger damping force.

Refer to FIG. 2, a braking rocker arm 314 and a braking arm hinge 315 are provided connecting the second braking block 313 of the inner braking component 31. The steel wire rope 50 is wrapped around the wedge wheel 6 which is fixed with the brake hub 312 and guided by the line-guiding mechanism 4. Under damping of the inner braking component 31, the rotation of the wedge wheel 6 would be controlled in order to adjust the speed of the steel wire rope 50. In an embodiment of the present invention, the guide angle of the wedge wheel is between 25° to 35° degrees, and preferably configured to be 30°. The purpose of the guide angle is to prevent the steel wire rope from sliding down from the wedge wheel 6. The steel wire rope 50 could be attached more closely to the inner-wall of the wedge wheel 6 to prevent the slipping of the steel wire rope. The value of sliding friction depends on the size of the guild angle. The length of steel wire rope 50 depends on the height of the building. The rolled plate 52 is disposed outside the descent rescue device. The steel wire rope 50 might be cut off quickly with the rope ring 51.

The outer braking component 30 comprises a power handle 301 and a helping handle 302. The locking mechanism abuts against the power handle 301 and the helping handle 302. The power handle 301 is disposed above the helping handle 302. While pulling the power handle 301 downward, the descent speed of the descent rescue device could be adjusted with different force pulling the power handle 301. When the descent speed is higher than 3 m/s, the descent speed would also be kept in control by the damping force between the first braking block 311 and brake hub 312. The helping handle 302 is fixed onto the shaft plate 7 and therefore kept still. The power handle 301 is connected dynamically to the block linkage arm 310*b* by a linkage arm 303, and the linkage arm 303 is connected with one end of a handle linkage axis 310*c*, whose another end is close to the block linkage arm 310*b* of the inner braking component 31. As the power handle 301 is pulled by a force, the linkage arm 303 will be moving toward the opposite direction. The swing track is enlarged with the increasing of the force from the power handle 301. As the force acting on the power handle 301 is beyond a maximum threshold, the pressure on the outer braking component 30 would be converted to the damping force of the inner braking component 31. The end of the linkage arm 303 approaches and pushes the block linkage arm 310*b* so as to rotate the block closing rotation roller 310*a*. With the rotation of the block closing rotation roller 310*a*, the first friction block 310*d* would be pressed against the brake hub 312 to lock the descent rescue device. When a force below the maximum threshold pushes the power handle 301 down, then the second braking block 313 and the brake hub 312 would unlock the wedge wheel 6, and the descend rescue device would descent slowly. When the power handle 301 is released, the descent rescue device 100 would be locked.

For adjusting the gap between the linkage arm 303 and the block linkage arm 310*b*, an adjusting bolt 304 is provided at the end of the linkage arm 303 which is close to the block linkage arm 310*b* of the inner braking component 311. The gap of the linkage arm 303 and the block closing rotation roller 310*a* could be decreased or increased by rotating the adjusting bolt 304 accordingly. By decreasing the gap of the linkage arm 303 and the block closing rotation roller 310*a* with rotation of the adjusting bolt 304, the force acting on the power handle 301 sufficient to lock the descent rescue device 100 would be reduced, and vice versa. By adjusting the gap between the adjusting bolt 304 and the block linkage arm 310*b* the sensitivity and the reliability of the descent rescue device would be controlled, and the contact area between the linkage arm 303 and the block linkage arm 310*b* is accordingly controlled to reduce influencing of the mechanical friction between the linkage arm 303 and the block linkage arm 310*b*. If the adjusting bolt 304 wears out, then only the adjusting bolt 304 is needed be changed so as to reduce the material breakage and the maintenance cost.

A fixed bayonet is provided at one end of the braking rocker arm 314. When no force acts on the power handle 301 and the helping handle 302, the locking mechanism 32 abuts against the power handle 301 and the helping handle 302 to hold the position of the power handle 301 and presses the outer braking component 30 against the brake hub 312 to lock the brake hub 312 and the wedge wheel 6. The locking mechanism 32 is used to hold the position of the power handle 301 and the helping handle 302 for locking the decent rescue device braking with the outer braking component 30. The locking mechanism 32 comprises a brake-pushing puller 320, a brake-adjusting nut 321, a brake-tightening spring 322 and a braking assembly base 323. The brake-pushing puller 320 passes through the hole of the fixed bayonet and fixed on the outer braking component 30 with the brake-adjusting nut 321. The braking assembly base 323 is fixed on the outer shell 1. For the resetting of the helping handle 302, the brake-tightening spring 322 abuts against the brake-adjusting nut 321 and the braking assembly base 323. When no force acts on the brake-pushing puller 320, the power handle 301 and the helping handle 302 are always held apart from each other by the restoring force of the brake-tightening spring 322. When a force acts on the power handle 301, then the power handle 301 can push the brake-pushing puller 320 to unlock the first braking block 311, and then the wedge wheel 6 can be rotated to lead down the steel wire rope 50 while the first braking block 311 and the brake hub 312 are separated.

If the power handle 301 is at free state, i.e. no force acts on the power handle 301, the brake hub 312 and the second braking block 313 will be pressed together to generate the damping force to lock the decent rescue device 100. When a force beyond the maximum threshold acts on the power handle 301 and the helping handle 302, the power handle 301 compresses the locking mechanism 32 to the greatest extent, the power handle 301 could drive the linkage arm 303 to rotate together with the block closing rotation roller 310*a*. The first friction block 310*d* is pushed against the brake hub 312 to generate damping force between the first friction block 310*d* and the brake hub 312 so that the descent rescue device 100 would be locked. If the locking mechanism 32 is pulled to a certain extent by a force below the maximum threshold acting on the power handle 301, the outer braking component 30 will be released, and the descent rescue device is unlocked, and there are certain damping force between the first friction block 310*d*, the brake hub 312 and the second braking block 313. The damping force between the brake hub 312 and the first braking block 311 is configured to be lower than the gravity of the load, the steel wire rope 50 could be released limited from the outer braking component 30. The rotation of the wedge wheel 6 depends on the action of the outer braking component 30. The steel wire rope 50 will be released with the rotation of the wedge wheel 6. And the rotation speed of the wedge wheel 6 depends on the damping force and the gravity of the load. The descent speed could be controlled by the force acting on the power handle 301. When the damping force between the first friction block 311 and the brake hub 312 is greater than the weight of the load, the descent rescue device would be locked.

The line-guiding mechanism 4 comprises a pair of guide wheels 40, a sliding briquetting 41 and a briquetting spring 42, wherein the guide wheels 40 are disposed near an opening of the outer shell 1, the sliding briquetting 41 is assembled beside the guide wheels 40, the briquetting spring 42 abuts against the sliding briquetting 41 and the outer shell 1 pressing the sliding briquetting 41 against the guide wheel 40. With the adjustment of the guide wheel 40 and the sliding briquetting 41, the movement of the steel wire rope 50 could be limited to avoid friction between the steel wire rope 50 and the outer shell 1 when the steel wire rope 50 passes through the opening. If the sliding briquetting 41 is frayed, the briquetting spring 42 will compensate the gap produced by fray through dynamic compensation for maintaining effective sliding friction between the sliding briquetting 41 and the guide wheels 40. At the same time, the sliding friction could be increased by the sliding of the sliding briquetting 41 for the purpose including preventing the steel wire rope from slipping off the wedge wheel 6 during the releasing and retracting of the steel wire rope 50, and enhancing the guiding upon the steel wire rope 50. So that the sliding briquetting 41 could maintain the pressure on the steel wire rope 50 after long-term uses. The sliding briquetting 41 is provided for limiting the steel wire rope 50 and maintains the sliding friction between the guide wheels 40 and the sliding briquetting 41, so that the friction between the steel wire rope 50 and the wedge wheel 6 are maintained to prevent the steel wire rope 50 from slipping off the wedge wheel 6. The guide wheels 40 are provided for guiding the steel wire rope 50 to the bottom of the wedge wheel 6, and then the friction area between the wedge wheel 6 and the steel wire rope 50 will be minimized to prevent the steel wire rope 50 from slipping off the wedge wheel 6 similarly.

The outer component 30 and the line-guiding mechanism 4 is disposed at different sides of the outer shell 1 to avoid interference between the outer braking component 30 and the steel wire rope 50.

If a target needs to be rescued by the descent rescue device 100, the operating procedure is provided as follows: first of all, hanging the hanging ring 22 on the building tightly and fastening the pothook of the belt of the target on the rope ring 51 target being rescued; after that, the target being rescued should hold the steel wire rope, then the target should depart from the building. Then the descent rescue device is in a load state, if the weight of the target is less than the setting weight (e.g. 29 kg), the spring traction tube 23 will remain still. If the weight of the target is greater than the setting weight, the spring traction tube 23 will be compressed. The compression depends on the weight of the target, that is to say, the compression of the spring traction tube 23 will increase while the load increases, and vice versa. With the pulling down of the spring traction tube 23, the energy conversion spring 210 and the buffer spring 212 will be compressed to produce a certain elastic restoring force for balancing the load gravity to control the descent speed. The energy conversion puller 25 can be pulled by the energy conversion adjusting screw 20 to drive the block closing rotation roller 310*a* to rotate and transmit the elastic energy to the first friction block 310*d*, then the damping force between the first braking block 311 and the brake hub 312 will change. If the first braking block 311 is pressed against the brake hub 312, a great friction will be generated between the first braking block 311 and the brake hub 312 to transform the elastic energy of the energy conversion spring 210 and the buffer spring 212 into mechanical energy, and then transmit the mechanical energy into the first braking block 311 by the energy conversion adjusting screw 20, so that the damping force will be produced between the first braking block 311, the brake hub 312 and the second braking block 313 for controlling the descent speed of the target being rescued. That is to say, when the weight of the target being rescued is heavier, the load would be larger and the damping force from the inner braking component would also be greater, so that the elastic restoring force from the energy conversion spring 210 and the buffer spring 212 would be greater corresponding to the weight of the target. The damping force of the inner braking component and the elastic restoring force from the tyra mechanism are equal to the weight of the target, so as to keep the descent rescue device 100 to descend in a constant speed and avoid potential danger to the target being rescued caused by a higher descent speed. With the first friction block 310*d* operatively associated with the brake hub 312 and the energy conversion puller 25, the weight of the target will be compressed by the energy conversion spring 210. The elastic restoring energy could be transformed into the mechanical energy and transmitted to the block closing rotation roller 310*a* via the energy conversion adjusting screw 20. With the rotation of the block closing rotation roller 310*a*, the damping force would be produced between the first friction block 310*d* and the brake hub 312 to slow the descent rescue device down.

The descent rescue device 100 also comprises the outer braking component 30 to enable the target being rescued to control the descent speed by himself. And the descent rescue device could be held anytime in the air.

The outer braking component 30 is operatively associated with the inner braking component 31. When a force beyond the maximum threshold acts on the outer braking component 30, the power handle 301 would be pushed toward the helping handle 302. The pressure on the power handle 301 would be transmitted to the linkage arm 303 to pull the block closing rotation roller 310*a* rotating by a certain angle, so that the energy can be transmitted to the first braking block 311 and the brake hub 312 to produce a damping force to lock the descent rescue device 100. That is to say, when no force acts on the outer braking component 30 the descent rescue device is locked and held until the target being rescued gets ready to descend. Moreover, during the descent, if the target being rescued releases the power handle 301 by accident, the outer braking component will be locked quickly. Conversely, if the target being rescued pulls the power handle 301 and the helping handle 302 to the greatest extent with a force beyond the maximum threshold, the block braking component also can transmit the force to the inner braking component 31 for causing the inner braking component to lock the descent rescue device. Whether the target being rescued holds the outer braking component 30 or not, the inner braking component 31 could produce a large damping force to lock the descent rescue device 100 during the descent. Until the force on the outer braking component 30 is moderated, the damping force between the braking hub 312 and the second braking block 313 would decrease so that the steel wire rope could be released freely and then the target being rescued could fall by a constant speed. At the same time, the descent speed can be adjusted by controlling the distance between the power handle 301 and the helping handle 302. If the distance decreases, then the descent will slow down, if the distance increases, then descent will be faster. The descent speed is controlled by the damping and can be adjusted according to the need, so it will not become a free-descent motion. Meanwhile, compared to prior descent rescue devices, the present descent rescue device 100 could be held in any altitude in the air, avoiding danger when landing. For people who don't have good mental qualities, the present device gives them time to be prepared to descent, which is of great value in practical operation.

The descent rescue device 100 may comprises a hanging ring 22 on the tyra mechanism 2 and a rope ring 51 on one end of the steel wire rope. In applications of rescuing others, the hanging ring 22 might be fastened to the building or the like, the operator controls the descent speed. In applications of self rescuing, the rope ring 51 might be fastened to the building tightly and hanging ring 22 might be coupled to the pothook of the belt on the body, and one can control the descent status and speed all by himself. And then, the descent rescue device achieves the purposes of descent many times back and forth from the high building to the ground by multiple people with control of descent status and speed.

The steel wire rope 50 comprises two ends, one of which is connected to the rope ring 51 and the other connected to a rolled plate 52. When the first target being rescued lands safely, the rolled plate 52 releases the rope to allow the rotation of the wedge wheel 6. Cutting the excess rope of the rolled plate 52 according to the height of the building; after fastening the pothook of the belt on the rope ring, one can repeat the process of rescuing the first target and get the second target down to the ground safely. Therefore the descent rescue device achieves the purposes of descent many times back and forth by many people despite the limitation of the length of rope in high building rescue applications.

The control of the descent is achieved by the interaction and mutual restraint of multiple braking components. The status and speed of the descent could be controlled by the operation of the outer braking component. When no force or the force beyond the maximum threshold acts on the outer braking component, the double braking mechanism would lock the descent rescue device and hold the position of the target being rescued. With a force lower than the maximum threshold, the descent rescue device would be unlocked.

The safety requirement for descent rescue from high buildings is very high. Friction between mechanical components influences the accuracy a lot. Without real-time adjusting, it may affect the safety. In the present invention, to avoid accuracy declining after long-term use, the spring is set to align and adjust the position of the quick-wearing components through its recovery. In the mean time, the spring, which acts as a buffer, produces a certain elastic restoring force for resisting the load gravity so the target being rescued can be slowed down at a smooth speed. The device both guarantees people's safety and helps overcoming their mental barrier.

The braking rocker arm and the descent rescue device can be respectively configured as independent parts so that the user can select suitable length of the steel wire rope according to the height of the building, and the manufacturability, adaptability and mobility of device is increased while the weight is controlled and structure is simplified.

The descent rescue device in the present invention surpasses the operational mode of prior descent rescue devices by adopting a new design concept. It not only has advantages such as reasonable structure design, small size, light weight and high mobility, but also has high safety coefficient, high controllability, better braking performance, constant speed descent, and is feasible to be used back and forth by multiple persons and hold at any altitude in the air. The present descent rescue device solves the defects which existed in prior devices such as heaviness, large volume, and low controllability. Therefore, the descent rescue device in the present invention brings to the application of fire control devices a new solution of high building rescue.

The invention claimed is:

1. A descent rescue device with a double brake with back and forth control comprising an outer shell and a tyra mechanism, a wedge wheel, a double braking mechanism and a line-guiding mechanism disposed inside the outer shell, wherein the tyra mechanism comprises an energy conversion adjusting screw having an elastic buffer disposed thereon, the double braking mechanism comprises an outer braking component, an inner braking component and a locking mechanism, wherein the inner braking component is operatively associated with the energy conversion adjusting screw of the tyra mechanism, the wedge wheel is disposed between the inner braking component and the outer braking component, a bundle of steel wire rope is wrapped around the wedge wheel, the locking mechanism abuts against the outer braking component and the outer shell; wherein during rescue operation, when no force or a force beyond a maximum threshold acts on the outer braking component, the wedge wheel is locked by the outer braking component and the inner braking component; when a force lower than the maximum threshold acts on the outer braking component, the energy conversion adjusting screw of the tyra mechanism triggers the inner braking component to provide a certain damping force such that the wedge wheel is unlocked and the steel wire rope exits the outer shell guided by the line-guiding mechanism; the inner braking component comprises a main axis, a first braking block, a braking hub, a second braking block, a block linkage arm and a block closing rotation roller, wherein the first braking block is disposed on the main axis, and operatively connected with the energy conversion adjusting screw of the tyra mechanism via the block linkage arm and the block closing rotation roller, the brake hub is disposed between friction blocks and the second braking block and fixed with the wedge wheel, and during the rescue operation, when the tyra mechanism is pulled out of the outer shell by the gravity of a target being rescued, the energy conversion adjusting screw of the tyra mechanism then pulls the block linkage arm to rotate together with the block closing rotation roller, then the rotating block closing rotation roller pushes the first braking block against the brake hub and the second braking block to provide the damping force.

2. The descent rescue device according to claim 1, wherein the first braking block comprises a first friction block and a second friction block; the main axis supported on a shaft plate comprises two opposite ends having two block gaps receiving the first and second friction blocks, the first friction block is connected to the energy conversion adjusting screw of the tyra mechanism via the block linkage arm and the block closing rotation roller; wherein during the rescue operation, the energy conversion adjusting screw pulls the block linkage arm to rotate together with the block closing rotation roller, then the rotating block closing rotation roller pushes the first friction block against the brake hub.

3. The descent rescue device according to claim 1, wherein the outer braking component comprises a power handle and a helping handle, wherein the power handle is connected to the block linkage arm via a linkage arm, and the helping handle is fixed to the outer shell; when no force acts on the power handle and the helping handle, the locking mechanism is operationally associated with the outer brake component and abuts against the power handle and the helping handle to hold the position of the power handle, and presses the outer braking component against the brake hub to lock the brake hub and the wedge wheel; when the force beyond the maximum threshold acts on the power handle and the helping handle, the power handle then drives the linkage arm to push the block closing rotation roller to rotate, the rotating block closing rotation roller pushes a first friction block against the brake hub to lock the brake hub; when the force lower than the maximum threshold acts on the power handle, the power handle moves towards the helping handle and presses against the locking mechanism, the locking mechanism releases the outer braking component to unlock the brake hub.

4. The descent rescue device according to claim 3, wherein the locking mechanism comprise a brake-adjusting nut, a brake-tightening spring, a braking assembly base and a brake-pushing puller, wherein the braking assembly base is fixed to the outer shell and has a through hole; one end of the brake-pushing puller far from the power handle passes through the through hole; the brake-adjusting nut fixes the outer braking component to the brake-pushing puller, the brake-tightening spring abuts against the brake-adjusting nut and the braking assembly base.

5. The descent rescue device according to claim 1, wherein the tyra mechanism further comprises a hanging ring, a spring traction tube and a elastic buffer tube, the buffer comprises an energy conversion spring and a buffer spring, the energy conversion spring abuts against the energy conversion adjusting screw and the spring traction tube, and the buffer spring abuts against the spring traction tube and the buffer tube, the hanging ring is connected with the buffer tube.

6. The descent rescue device according to claim 1, wherein the line-guiding mechanism comprises a pair of guide wheels, a sliding briquetting and a briquetting spring, wherein the guide wheels are disposed near a opening of the outer shell, the steel wire rope passes through the gap between the guide wheels, the sliding briquetting is disposed beside the guide wheels, the briquetting spring abuts against the sliding briquetting and the outer shell pressing the sliding briquetting against the guide wheels.

7. The descent rescue device according to claim 1, wherein a guide angle of the wedge wheel is between 25° and 35°.

8. The descent rescue device according to claim 1, wherein the outer braking component and the line-guiding mechanism are disposed at different sides of the outer shell.

* * * * *